United States Patent [19]

Phillips

[11] Patent Number: 4,967,622

[45] Date of Patent: Nov. 6, 1990

[54] BEVERAGE CONTAINER OPENER

[76] Inventor: David S. Phillips, 821-68th St., S.E., Apt. 5, Kentwood, Mich. 49508

[21] Appl. No.: 471,399

[22] Filed: Jan. 29, 1990

[51] Int. Cl.[5] ..... B67B 7/44

[52] U.S. Cl. ..... 81/3.09; 81/3.4; 81/3.55; 7/151

[58] Field of Search ..... 81/3.07, 3.09, 3.4, 81/3.55; 7/151; D8/18, 33, 34, 40

[56] References Cited

U.S. PATENT DOCUMENTS

| | | | |
|---|---|---|---|
| D. 277,725 | 2/1985 | Silkebakken | D8/40 |
| 1,607,620 | 11/1926 | Hansberger . | |
| 2,568,612 | 9/1951 | Cullen . | |
| 3,724,297 | 4/1973 | Bucko . | |
| 4,309,921 | 1/1982 | Miller . | |
| 4,455,894 | 6/1984 | Roberts . | |
| 4,474,087 | 10/1984 | Widman . | |
| 4,507,988 | 4/1985 | LoFaso et al. . | |
| 4,549,451 | 10/1985 | Widman . | |
| 4,723,465 | 2/1988 | Huges . | |

*Primary Examiner*—Roscoe V. Parker
*Attorney, Agent, or Firm*—Michael A. Mohr

[57] ABSTRACT

A multiple-function beverage container opener is provided which features an ergonomically-shaped, elongate body having a stay-on tab opener on one end thereof, a crimped-on bottle cap opener on the opposite end thereof, and twist-off bottle opener in a central socket portion thereof. The stay-on tab opener is characterized by an arcuate loop formed between outboard and inboard arcuate-shaped lances. The arcuate-shaped lances and loop are provided with a radius that is substantially similar to the rim of the beverage container lid so that the loop fits between the tab handle and the rim of the beverage container. A ramp is coined in the arcuate loop to further assist in the camming of the tab handle upwardly into the arcuate loop for further pivoting and opening of the scored closure of the stay-on tab opener. The socket formed in the central portion of the opener contains and arcuate array of gear-shaped socket teeth provided with a pitch that is approximately twice the pitch of the gear-shaped cap teeth disposed on the twist-cap, the socket teeth having a nominal diameter somewhat greater than the diameter of the cap teeth so that a quick and effective fit is achieved for the operation of the twist-off cap. The end of the opener opposite the stay-on tab opener contains a pry-bar type opener for crimped-on bottle caps.

8 Claims, 4 Drawing Sheets

BEVERAGE CONTAINER OPENER

BACKGROUND OF THE INVENTION

1. Field Of The Invention

The present invention relates generally to the field of beverage container openers and more particularly is directed to a multi-purpose tool for manipulating pull-type can opening tabs, twist-off bottle caps, and crimped-on bottle caps.

2. Description Of The Prior Art

Metal beverage container cans were originally opened with a V-shaped piercing tool for opening the top of the container. The tool comprised the V-shaped piercing blade and a cooperating hook for engaging the periphery of the container. More recently, metal beverage container cans have employed an opener built-in or directly mounted atop each can. Originally, these types of openers were known as pop top or pull ring can openers. Such pop top or pull ring can openers normally comprise a scored closure formed directly atop the lid of the metal container and a pull ring hinged, riveted, or otherwise suitably secured to the scored closure. In the operation of this type of can opener, the ring is pulled by the user to tear away the closure along the scored lid, completely removing the pull ring and closure from the lid. Often the pull ring and closure thereafter are improperly discarded as litter. Further, the sharp edges of the scored closure often present a safety hazard. A number of states have now passed anti-litter or bottle statutes which prevent the distribution of beverage containers having such self-mounted opening devices which are separable from the can.

More recently, a class of self-mounted can openers have been developed which employ opening systems using tabs commonly referred to as stay-on tabs. Like the pop top or pull ring can openers, a scored closure is provided on the metal lid of the beverage container. The tabs of the stay-on tab opener are also permanently affixed to the scored closure with a rivet, hinge, or the like. However, the scored closure in the stay-on tab opener is also permanently affixed to the beverage can lid with a deformable hinge. The tab simply acts as a lever to inwardly displace and deform the hinge on the scored closure, providing for the discharge of the contents of the beverage container while the scored closure and tab remain attached thereto, eliminating the possibility of litter and substantially reducing the possibility of injury from contact with the sharp edges of the scored closure.

Stay-on tabs, prior to use, include a tab handle which is disposed flush to the can lid, usually below the rim of the can. In the operation of the stay-on tab opener, the tab handle must be lifted or pivoted away from the lid of the can. To do so, the user generally must use fingernails to raise the tab handle, in a preliminary fashion, an amount sufficient to permit an adequate finger grip for further pivoting of the tab handle. Once the finger grip is established, the tab handle is pivoted upwardly to inwardly deflect the scored closure which is severed along the score line and then hinged downwardly into the can. The effort required to raise the tab handle can often intimidate some users of the can opening system and can injure the fingers or fingernails of the user. In a commercial establishment where a plurality of containers must be opened quickly under sometimes unfavorable conditions, considerable discomfort, breakage of fingernails, and bleeding can be encountered by the individuals who are manipulating hundreds of the closures during the course of a work day.

A number of tools are found in the prior art for opening pull ring cans, twist-off bottle caps, and crimped-on bottle caps. Many of the tools found in the prior art feature a combination of these types of openers embodied in one tool. However, in all of the prior art designs, various compromises are present. For example, in the case of the most prevalent type of stay-on tab opening tool, it is typical for the tool to be provided with a tab plunger for pressing the scored closure downwardly and pivoting it into the beverage container when the tab handle is lifted. This often results in contact between the tab plunger and the contents of the beverage container, and such contact is not always considered desirable or sanitary. In many of the multiple-purpose tools found in the prior art, the various implements disposed on the tool are placed for reasons of manufacturing expediency, and not to enhance the operation or comfort of the tool in the hand of the user.

SUMMARY OF THE INVENTION

According to the present invention, a multi-purpose beverage container opener is provided which solves these and other problems in the prior art. The beverage container opener is particularly directed to containers of the type having a stay-on tab, a twist-off bottle cap, or a crimped-on bottle cap. In the case of a stay-on tab opener, the beverage container opener of the present invention is provided with an elongate, generally planar body having a tab engagement loop disposed on one end thereof. The tab engagement loop is formed from an arcuate-shaped outboard lance and arcuate-shaped inboard lance, the outboard and inboard lances being provided with a radius that is substantially similar to the radius of the rim of the beverage container lid. An arcuate loop is formed between the outboard and inboard lances, the arcuate loop being adapted to fit between the outside radius of the beverage container lid and the tab handle of the stay-on tab opener. An inclined ramp is coined in the arcuate loop, the ramp comprising an inclined surface adapted for insertion under the tab handle to cam the tab handle upwardly into the arcuate loop. An ergonomically-shaped opener handle is formed in the elongate, generally planar body of the beverage container opener. When the user manually grasps the opener handle, the arcuate loop is placed between the beverage container rim and the tab handle. The ramp is then inserted under the tab handle to cam the tab handle upwardly into the arcuate loop. Thereafter, the beverage container opener handle is pivoted upwardly to depress the tab plunge of the stay-on tab opener against the scored closure to sever the closure along the scored lines and displace it inwardly, opening the beverage container.

In a preferred embodiment, the multi-purpose tool further comprises a socket formed in a central portion of the elongate body for engaging the arcuate array of projections disposed about the periphery of a twist-off beverage container cap. This socket provides a major dimension of the ergonomically-shaped opener handle which extends transversely with respect to the ends of the elongate-shaped handle. The major dimension of the socket is adapted to fit within the user's grasp. A plurality of gear-shaped socket teeth are disposed in the socket, the socket teeth being provided with a cross section which is substantially equal to the cross section of the gear-shaped cap teeth disposed about the beverage container cap. The pitch of the socket teeth is approximately twice the pitch of the cap teeth. Further, the socket teeth are provided with a median ring diameter which is larger than the median diameter of the cap teeth, whereby the user inserts the beverage container cap in the socket, engaging the cap teeth with the socket teeth and opening the beverage container with a twist of the hand. The force required to grip and twist the cap is thus greatly reduced by the gear-like engagement of the cap and the leverage provided by the elongate body.

Further, the preferred embodiment of the invention includes a pry-type beverage bottle opener for removing crimped-on beverage container caps comprising a cap loop for encompassing the beverage container cap and a pry bar for prying up the edge of the cap and removing the same. The stay-on tab opener and the pry-type beverage bottle opener are disposed on opposing ends of the elongate body of the beverage container opener with minor diameters of the ergonomically-shaped opener handle defined between the centrally-located socket and the stay-on tab opener and pry-type opener, which are disposed on opposing ends of the handle. The minor diameters of the ergonomically-shaped beverage container handle extend transversely with respect to the ends of the elongate, generally planar body and define apertures for receiving the fingers of the user when the handle of the bottle opener is grasped to operate one of the multiple functions of the bottle opener.

DESCRIPTION OF THE PREFERRED EMBODIMENTS

Figure 1:
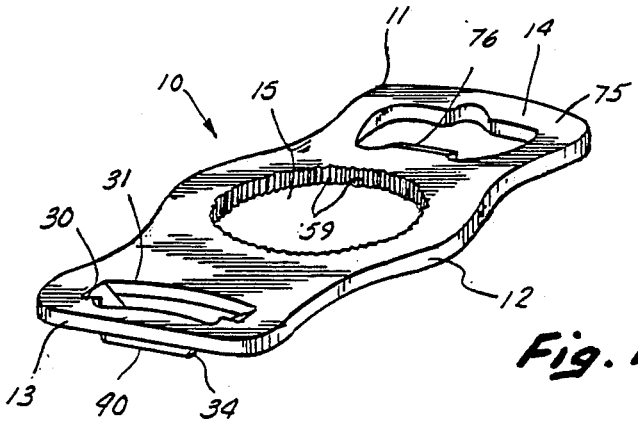
FIG. 1 is a perspective view of the multiple-use beverage container opener of the present invention.

With reference now to the Figures, particularly FIGS. 1, 2, 3 and 4, the multiple-purpose beverage container opener of the present invention is generally illustrated at 10. The beverage container opener comprises an elongate, generally planar body 11 having a central portion 12, a first end 13 and a second end 14. The central portion 12 comprises a socket 15 for receiving a twist-on beverage container cap, the first end 13 includes a tab engagement means and the second end 14 includes a pry-type bottle opener for crimp-on bottle caps.

Figure 5:
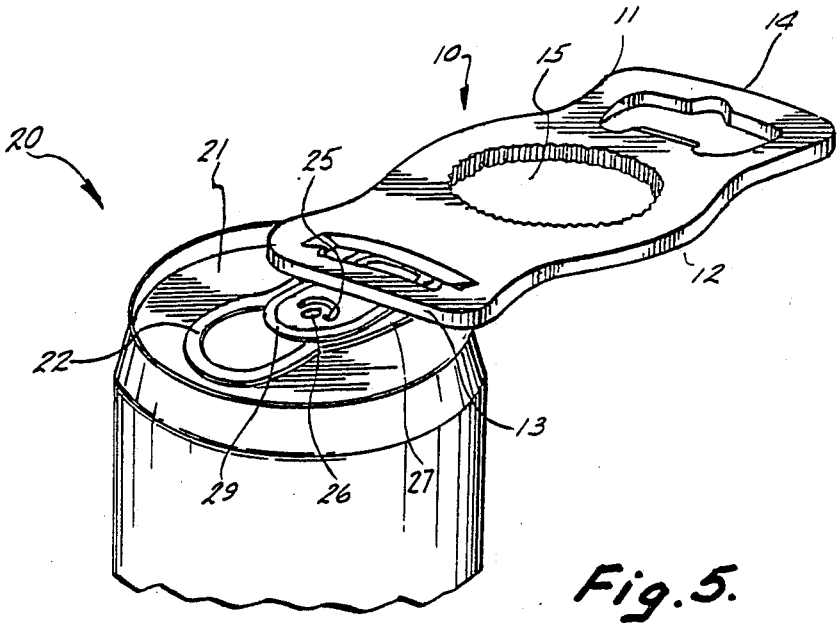
FIG. 5 is a perspective view of the opener of the present invention applied to a stay-on tab beverage container opener.
Figure 6:
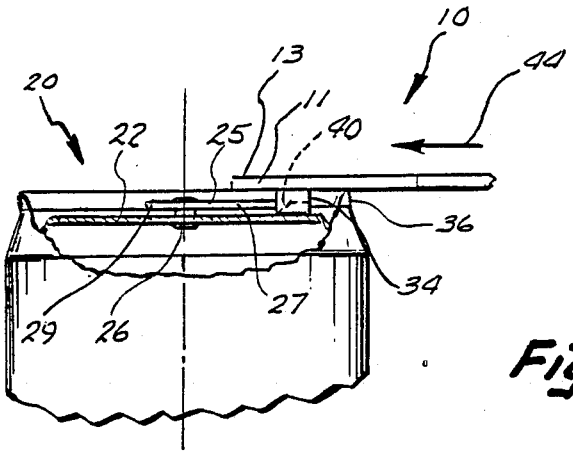
FIG. 6 is a side elevation view partially in section of the opener applied to a stay-on tab can opener.
Figure 7:
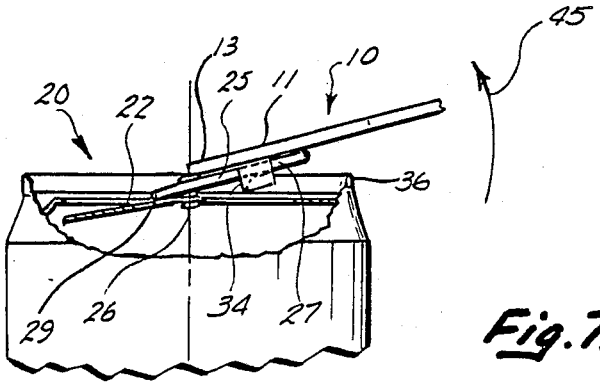
FIG. 7 is another side elevation view partially in section of the opener applied to a stay-on tab can opener.

With reference now also to FIGS. 5, 6 and 7, the beverage container opener 10 of the present invention is illustrated with a stay-on tab type of beverage container generally illustrated at 20. Stay-on tab openers 20 normally comprise a circular lid 21 having a scored closure 22 disposed therein. The scored closure 22 is adapted to be inwardly displaced as illustrated in FIG. 7 by a lever tab 25 which is secured to the scored closure by a rivet 26. The lever tab 25 is provided with a tab handle 27 adapted to be raised away from the lid 21 and a tab punch 29 for depressing the scored closure 22 downwardly when the tab handle 27 is pivoted upwardly. The scored closure 22 contains a hinge portion that is contiguous with rivet 26 and the metallic lid 21 of the beverage container so that once the stay-on tab opener is actuated by pivoting the lever tab 25 upwardly and depressing the scored closure 22 downwardly, the scored closure and the lever tab 25 are retained atop the beverage container.

With particular reference now to FIGS. 1–5, the first end 13 of the elongate, generally planar body 11 of opener 10 comprises a tab engagement means for lifting the tab handle 27. The tab engagement means comprises an arcuate-shaped outboard lance 30 and an arcuate-shaped inboard lance 31. The arcuate-shaped outboard and inboard lances 30 and 31 are provided with a radius R that is substantially similar to the inside radius of the rim or periphery of the beverage container lid 21. An arcuate loop 34 is formed in the tab engagement means between the outboard and inboard lances 30 and 31, the loop 34 extending downwardly from the planar body 11 for encompassing the tab handle portion 27 only of the lever tab 25. The arcuate loop 34 is adapted to fit between the outside radius or rim 36 of the container lid 21 and the tab handle 27 as best illustrated in FIGS. 6 and 7.

A ramp 40 is coined in the arcuate loop 34. The ramp 40 comprises an inclined surface adapted for insertion under the tab handle 27 for camming the tab handle 27 upwardly into the arcuate loop 34. As best illustrated in FIG. 7, once the tab handle is encompassed by the arcuate loop 34 it is secured between the planar body 11 of the opener and the arcuate loop 34.

Figure 8:
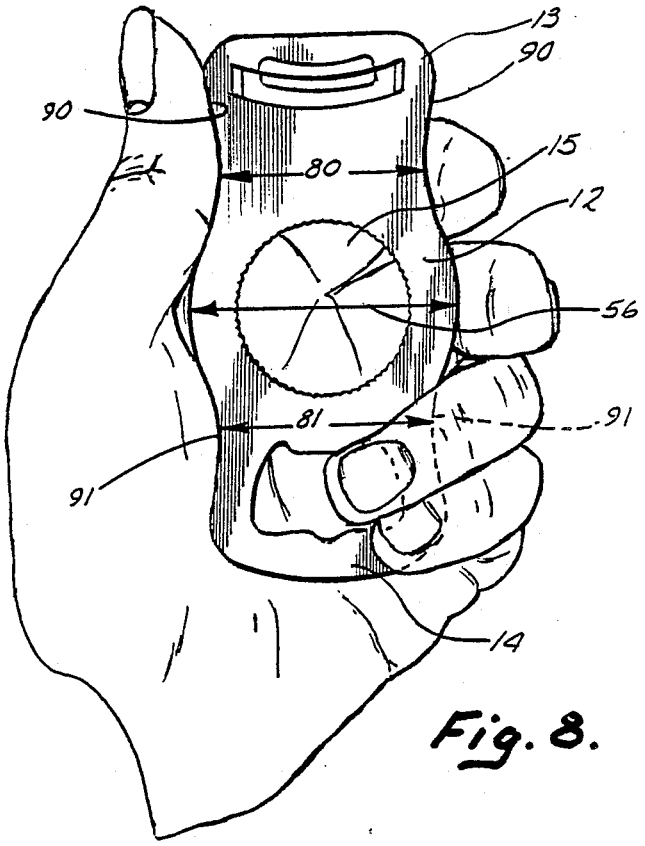
FIG. 8 is a top elevation view of the opener of the present invention illustrated in the grasp of a user.

As best illustrated in FIG. 8, an ergonomically-shaped opener handle is formed by the central portion 12, the first end 13, and the second end 14 so that the elongated body 11 of the opener 10 can be manually grasped by the user. In the operation of the stay-on tab opener, the opener is grasped between the thumb and fingers of the user as generally illustrated in FIG. 8 and the arcuate-shaped loop 34 of the stay-on tab opener is disposed between the rim 36 of the container lid and the tab handle 27 of the stay-on tab opener as best illustrated in FIGS. 5 and 6. Thereafter, as best illustrated in FIG. 6, the tool 10 is displaced inwardly toward the center of the beverage container in the direction of the arrow 44 so that the inclined ramp 40 of the arcuate loop 34 engages the tab handle 27 and cams the tab handle 27 upwardly into the arcuate loop 34. With the tab handle 27 thus encompassed by the arcuate loop 34 and a portion of the planar body 11 of the tool, the tool is pivoted upwardly in the direction of the arrow 45 to depress the tab punch 29 of the stay-on tab against the scored closure 22 until the scored closure is displaced downwardly, opening the beverage container can, as best illustrated in FIG. 7. FIG. 7 illustrates that this is achieved without contact between the beverage container opener 10 and the liquid contents of the beverage container 20, thus serving sanitary considerations and without contact between the user's hands and the stay-on tab opener, substantially eliminating the possibility of discomfort or injury.

With reference now to FIGS. 1, 2, 8 and 9, it is illustrated that the multi-purpose opener 10 of the present invention further comprises a socket 15 disposed in the central portion 12 of the elongate body 11 of the opener. The socket 15 is adapted for engagement with the twist-off cap 50 of a large, generally liter-size or sixteen ounce size plastic beverage container bottle 51, best illustrated in FIG. 9. The cap 50 of the bottle 51 typically is provided with an arcuate array of gear-shaped, outwardly-directed projections or cap teeth 54 disposed about the circumference or periphery of the container cap. The cap teeth 54 are best illustrated in cross section in FIG. 10. As previously noted, the central portion 12 of the elongate body of the opener 10 which contains the socket 15, defines a major dimension 56 of the ergonomically-shaped opener handle which extends transversely with respect to the first and second ends 13 and 14 of the elongate, generally planar body 11. Again, as best illustrated in FIG. 8, the major dimension 56 is adapted to fit within the user's grasp.

Figure 10:
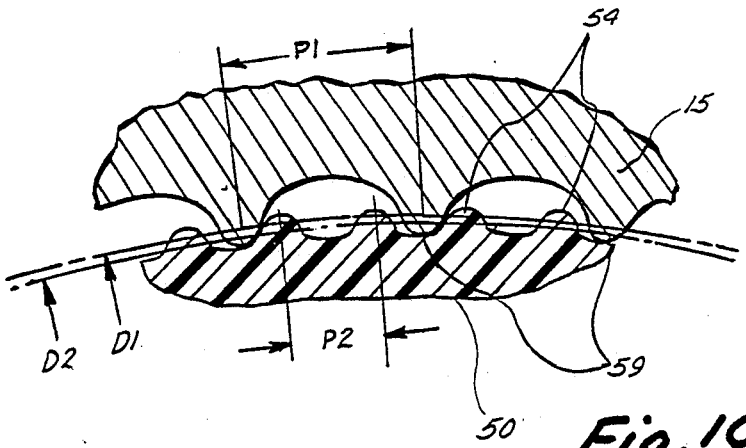
FIG. 10 is a partial sectional view of the socket teeth engaging the cap teeth on a twist-off plastic beverage container bottle.
Figure 9:
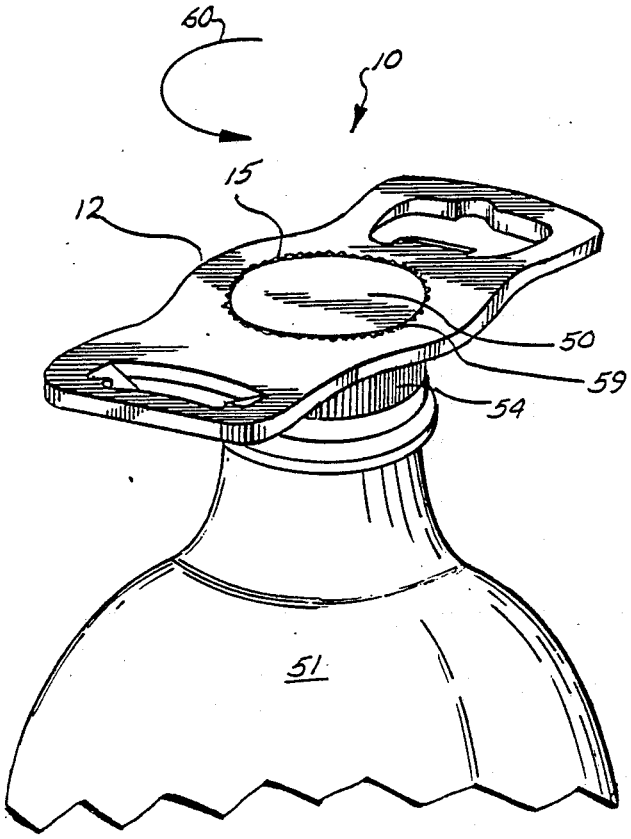
FIG. 9 is a perspective view illustrating the opener of the present invention on a twist-off cap of a plastic beverage container bottle.

With reference now also to FIG. 10, it is illustrated that the socket 15 is provided with a plurality of gear-shaped socket teeth 59. The socket teeth 59 are provided with a cross section which is substantially similar to the cross section of the cap teeth 54. The socket teeth 59 are inwardly directed about the periphery of the socket 15 to provide a ring-gear-like socket for engaging the pinion-gear-like beverage container cap 50. The socket teeth 59 of the socket 15 are provided with a pitch P1 that is approximately twice the pitch P2 of the cap teeth 54 of the bottle cap 50. Further, the socket teeth 59 of the socket 15 are provided with a median or nominal ring diameter D1 which is somewhat larger than the median or nominal ring diameter D2 of the cap teeth 54, whereby the user can insert the cap 50 of the beverage container in the socket 15, engaging the beverage container cap in a gear-like fit with the socket and twisting off the beverage container cap with an easy circular motion in the direction of the arrow 60. The gear-like fit between the socket and the cap dramatically reduces the required gripping force and the leverage provided by the elongate ergonomically-shaped body greatly reduces the force necessary to twist off the cap. The tool is thus an attractive appliance for users having a weak grip, such as those suffering from arthritis.

Figure 2:
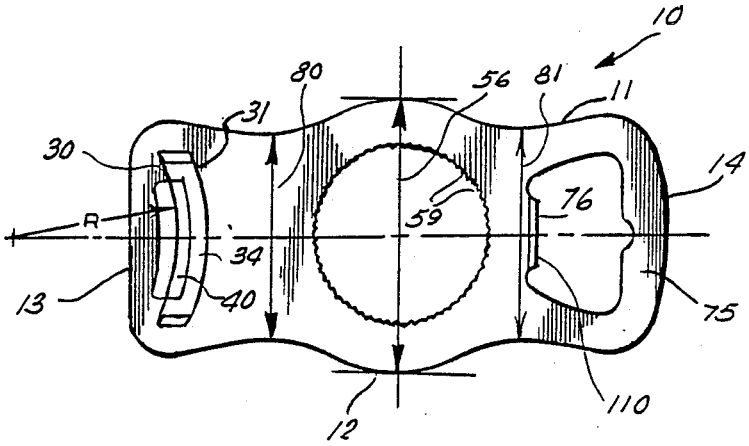
FIG. 2 is a top plan view of the opener.
Figure 3:
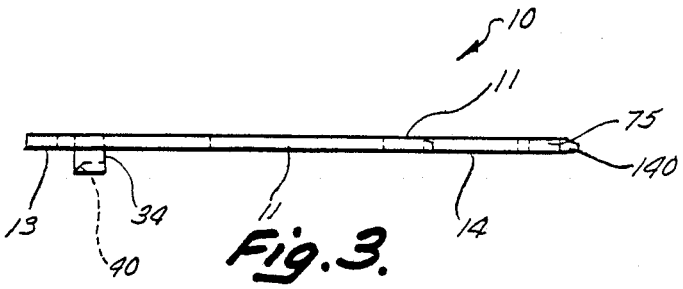
FIG. 3 is a side elevation view of the opener.
Figure 11:
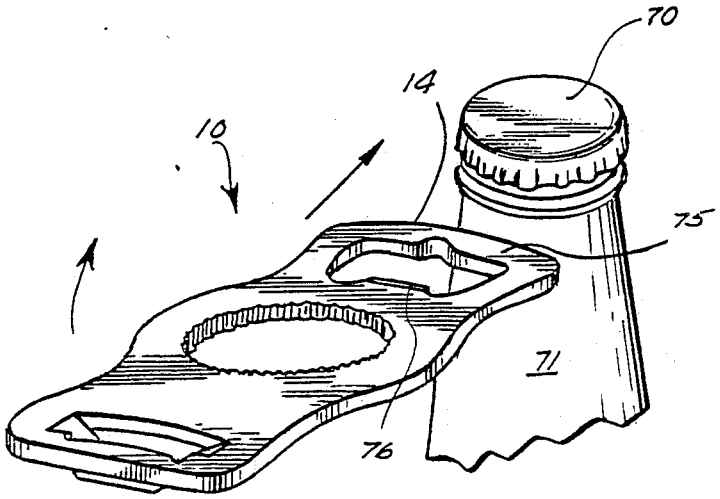
FIG. 11 is a perspective view of the opener applied to a crimped-on bottle cap of a glass beverage container bottle.

With reference now also to FIG. 11 as well as FIGS. 1, 2 and 3, it is illustrated that the second end 14 of the beverage container opener 10 further comprises a pry-type beverage bottle opener for removing the crimped-on beverage container cap 70 of a glass beverage container bottle 71. Such pry-type beverage bottle openers comprise a cap loop 75 for engaging the beverage container cap 70 and a pry bar 76 for prying up the edge of the cap 70 and removing the same. The operation of such pry-type beverage container openers is well-known in the art.

With particular reference now to FIGS. 2 and 8, it is further illustrated that the first and second ends 13 and 14 of the elongate, ergonomically-shaped, generally planar body 11 define first and second minimum or minor diameters 80 and 81 disposed between the tab engagement means at 13 and the pry-bar-type opener at 14, respectively. The minor diameters 80 and 81 extend transversely with regard to the elongate, generally planar body. As best illustrated in FIG. 8, the first minor diameter 80 is disposed between the stay-on tab opener 13 and socket 15 to provide a first pair of finger grips at 90 and the second minimum diameter 81 is disposed between the pry-bar-type opener and the socket 15 to provide a second pair of finger apertures at 91. Thus, the elongate planar body of the multiple-use beverage container opener of the present invention is easily grasped within the palm and fingers of the user with any stress from the opener evenly distributed over a wide surface area to ensure the safety and comfort of the user.

Figure 4:
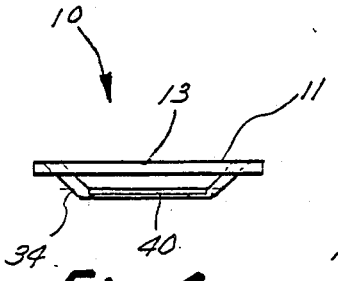
FIG. 4 is an end elevation view of the opener.

According to the preferred embodiment, the opener of the present invention is formed from sheet steel with stamping and coining steps. However, it should be understood that the opener may be formed from other materials, such as a polymeric material, with other steps, such as a molding step. With brief reference now to FIG. 12, an intermediate step in the manufacture of the opener 10 from a malleable metal material such as steel is illustrated. In this case, the malleable metal blank 100 is stamped, cut, or otherwise suitably formed from sheet metal stock with apertures disposed at 101 and 102 for defining the pry-bar-type opener disposed at 14 and the socket disposed at 15, respectively. In the case of the stay-on tab opener disposed at 13 on the first end of the opener 10 an arcuate relief opening 103 is provided along with the outboard and inboard lances 30 and 31, respectively. Thereafter, as best illustrated in FIGS. 1, 3 and 4, singular or multiple coining steps are provided for forming the downwardly extending, arcuate-shaped loop 34, the inclined ramp 40, and a sharpened tip at 110 for the pry-bar 76, best illustrated in FIG. 2.

Figure 12:
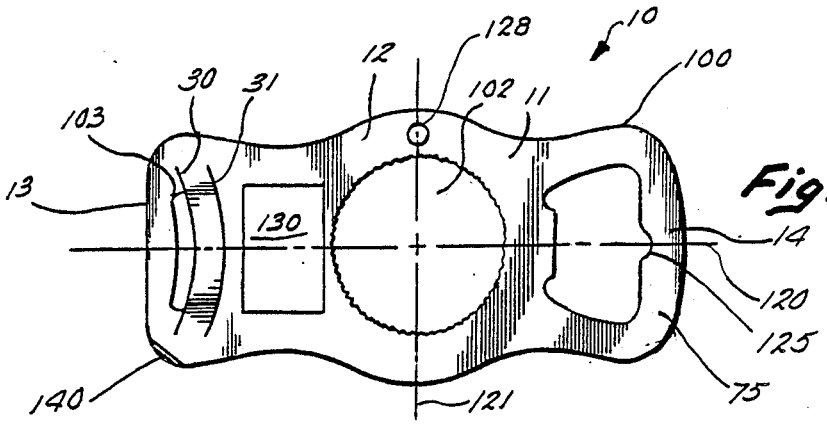
FIG. 12 is a top plan view of a blank formed from a malleable metal material representing an intermediate step in the manufacture of the opener of the present invention.

FIG. 12 also illustrates that the elongate body 11 is provided with an axial centerline 120 and a transverse centerline 121. The axial and transverse centerlines are substantially orthogonal and substantially bisect the opener 10. The cap loop 75 is provided with a hook aperture 125 for receiving a J-hook not illustrated herein. The openers are thus merchandised by hanging or storing the openers snugly or in a stack on a J-hook merchandising rack. The opener is also provided with a key aperture 128 for receiving a keychain not illustrated herein. The opener may be provided with a magnet 130 suitably placed or formed on the body of the opener so that the opener can also be conveniently stored on any environmental surface formed from a ferrous material. Further, the opener may be formed with a screw driver tip 140 disposed on one end thereof.

The foregoing description is exemplary and that of the preferred embodiment only. Modifications of the invention will occur to those who make and use the invention. It is desired to include within the scope of the present invention all such modifications that come within the proper scope of the appended claims.

The embodiments of the invention in which an exclusive property or privilege is claimed are defined as follows.

1. An opener for beverage containers of the type comprising a circular lid having a scored closure adapted to be inwardly displaced by a lever tab disposed adjacent the scored closure and attached to the lid, the lever tab having a tab handle adapted to be raised away from the lid and a tab punch for depressing the scored closure, the opener comprising:

an elongate generally planar body;

a tab engagement means for lifting said tab handle, said tab engagement means including an arcuate-shaped outboard lance and an arcuate-shaped inboard lance, said inboard and said outboard lances being provided with a radius that is substantially similar to a radius of the circular beverage container lid;

an arcuate loop formed in said tab engagement means, said loop extending from said planar body for encompassing the tab handle portion only of the lever tab, said arcuate loop being formed between said inboard and said outboard lances, said arcuate loop being adapted to fit between the radius of the beverage container lid and the tab handle;

a ramp disposed on said arcuate loop, said ramp comprising an inclined surface adapted for insertion under the tab handle for camming the tab handle upwardly into said arcuate loop; and an opener handle formed in said elongate generally planar body, whereby a user manually grasps said opener handle, places said arcuate loop between the periphery of the beverage container lid and the tab handle, inserts said ramp under the tab handle to cam the tab handle into said arcuate loop, and then pivots said opener handle upwardly to depress the tab punch against the second closure and open the beverage container.

2. An opener for beverage containers of the type comprising a circular lid having a scored closure adapted to be inwardly displaced by a lever tab disposed adjacent the scored closure and attached to the lid, the lever tab having a tab handle adapted to be raised away from the lid and a tab punch for depressing the scored closure, the opener comprising:

an elongate generally planar body having a central portion, a first end disposed on one end thereof and a second end disposed on the other end thereof;

a tab engagement means for lifting said tab handle, said tab engagement means including an arcuate-shaped outboard lance and an arcuate-shaped inboard lance, said inboard and said outboard lances being provided with a radius that is substantially similar to a radius of the circular beverage container lid;

an arcuate loop formed in said tab engagement means, said loop extending downwardly from said planar body for encompassing the tab handle portion only of the lever tab, said arcuate loop being formed between said inboard and said outboard lances, said arcuate loop being adapted to fit between the radius of the beverage container lid and the tab handle;

a ramp disposed on said arcuate loop, said ramp comprising an inclined surface adapted for insertion under the tab handle for camming the tab handle upwardly into said arcuate loop;

an ergonomically-shaped opener handle formed in said central portion, said first end and said second end of said elongate body whereby a user manually grasps said opener handle, places said arcuate loop between the periphery of the beverage container lid and the tab handle, inserts said ramp under the tab handle to cam the tab handle into said arcuate loop, and then pivots said opener handle upwardly to depress the tab punch against the scored closure and open the beverage container;

a socket formed in said central portion of said elongate body, for engaging an arcuate array of gear-shaped outwardly directed cap teeth disposed about the periphery of a twist-off beverage container cap, said socket providing a major dimension of said ergonomically-shaped opener handle extending transversely with respect to said first and second ends of said elongate generally planar body, said major dimension being adapted to fit within a user's grasp; and a plurality of gear-shaped socket teeth disposed in said socket, said plurality of socket teeth being provided with a cross section, substantially equal to the cross section of the gear-shaped cap teeth on the beverage container cap, said socket teeth being disposed in an inwardly-directed arcuate array disposed about said socket to provide a ring-gear-like socket for engaging a pinion-gear-like beverage container cap, said socket teeth being provided with a socket pitch, the cap teeth being provided with a cap pitch, said socket pitch being approximately twice the pitch of the cap pitch, said socket teeth being provided with a ring diameter, the projections on the beverage container cap being provided with a pinion diameter, said ring diameter being greater than said pinion diameter, whereby the user inserts the beverage container cap in said socket, engaging the beverage container cap with said socket teeth and twisting off the beverage container cap.

3. An opener for beverage containers of the type comprising a circular lid having a scored closure adapted to be inwardly displaced by a lever tab disposed adjacent the scored closure and attached to the lid, the lever tab having a tab handle adapted to be raised away from the lid and a tab punch for depressing the scored closure, the opener comprising:

an elongate generally planar body having a central portion, a first end disposed on one end thereof and a second end disposed on the other end thereof;

a tab engagement means for lifting said tab handle, said tab engagement means including an arcuate-shaped outboard lance and an arcuate-shaped inboard lance, said inboard and said outboard lances being provided with a radius that is substantially similar to a radius of the circular beverage container lid;

an arcuate loop formed in said tab engagement means, said loop extending downwardly from said planar body for encompassing the tab handle portion only of the lever tab, said arcuate loop being formed between said inboard and said outboard lances, said arcuate loop being adapted to fit between the radius of the beverage container lid and the tab handle;

a ramp disposed on said arcuate loop, said ramp comprising an inclined surface adapted for insertion under the tab handle for camming the tab handle upwardly into said arcuate loop;

an ergonomically-shaped opener handle formed in said central portion, said first end and said second end of said elongate body whereby a user manually grasps said opener handle, places said arcuate loop between the periphery of the beverage container lid and the tab handle, inserts said ramp under the tab handle to cam the tab handle into said arcuate loop, and then pivots said opener handle upwardly to depress the tab punch against the scored closure and open the beverage container;

a socket formed in said central portion of said elongate body, for engaging an arcuate array of gear-shaped outwardly directed cap teeth disposed about the periphery of a twist-off beverage container cap, said socket providing a major dimension of said ergonomically-shaped opener handle extending transversely with respect to said first and second ends of said elongate generally planar body, said major dimension being adapted to fit within a user's grasp;

a plurality of gear-shaped socket teeth disposed in said socket, said plurality of socket teeth being provided with a cross section, substantially similar to the cross section of said cap teeth, said socket teeth being disposed in an inwardly-directed arcuate array disposed about said socket to provide a ring-gear-like socket for engaging a pinion-gear-like beverage container cap, said socket teeth being provided with a socket pitch, the cap teeth being provided with a cap pitch, said socket pitch being approximately twice the pitch of the cap pitch, said socket teeth being provided with a ring diameter, the cap teeth being provided with a pinion diameter, said ring diameter being greater than said pinion diameter, whereby the user inserts the beverage container cap in said socket, engaging the beverage container cap with said socket teeth and twisting off the beverage container cap; and a pry-type beverage bottle opener for removing a crimped-on beverage container cap, said pry-type beverage bottle opener being disposed on said second end of said elongate, generally planar body, opposite said tab engagement means, said pry-type beverage container opener comprising a cap loop for encompassing the beverage container cap and a pry bar for prying up the edge of the cap and removing the same, said tab engagement means defining a first minor diameter of said ergonomically-shaped opener handle, said first minor diameter extending transversely with respect to said first and second ends of said elongate, generally planar body, said first minor diameter being disposed between said tab engagement means and said socket to provide a first finger grip adapted to receive a user's fingers when the user grasps said opener handle to operate the opener, said pry-type beverage bottle opener defining a second minor diameter of said ergonomically-shaped opener handle, said second minor diameter extending transversely with respect to said first and second ends of said elongate, generally planar body, said second minor diameter being disposed between said pry-type beverage bottle opener and said socket to provide a second finger grip adapted to receive a user's fingers when the user grasps said opener handle to operate the opener.

4. The opener of claim 3 wherein said elongate body is provided with an axial centerline and a hook aperture is provided in said cap loop for receiving a J-hook hanger, said hook aperture being disposed about said axial centerline.

5. The opener of claim 4 wherein said elongate body is provided with a transverse centerline which is substantially orthogonal to said axial centerline and said elongate body is provided with a key aperture disposed about said transverse centerline for receiving a key-chain.

6. The opener of claim 3 wherein said opener is formed from sheet steel with stamping and coining steps.

7. The opener of claim 3 further comprising a magnet disposed on said elongate body.

8. The opener of claim 6 wherein a screw driver tip is provided on said body, said screw driver tip being formed on said body.

* * * * *